US011498744B2

(12) United States Patent
Lee

(10) Patent No.: US 11,498,744 B2
(45) Date of Patent: Nov. 15, 2022

(54) HETEROGENEOUS CONTENTS MIXING CONTAINER

(71) Applicant: PUM-TECH KOREA CO., LTD, Incheon (KR)

(72) Inventor: Do Hoon Lee, Incheon (KR)

(73) Assignee: PUM-TECH KOREA CO., LTD, Incheon (KR)

( * ) Notice: Subject to any disclaimer, the term of this patent is extended or adjusted under 35 U.S.C. 154(b) by 367 days.

(21) Appl. No.: 16/858,338

(22) Filed: Apr. 24, 2020

(65) Prior Publication Data

US 2020/0346839 A1 Nov. 5, 2020

(30) Foreign Application Priority Data

May 3, 2019 (KR) ..... 10-2019-51968

(51) Int. Cl.

| | |
|---|---|
| ***B67D 1/00*** | (2006.01) |
| ***B65D 81/32*** | (2006.01) |
| ***B67D 3/00*** | (2006.01) |
| *B05B 7/08* | (2006.01) |

(52) U.S. Cl.

CPC ..... *B65D 81/3288* (2013.01); *B67D 1/0051* (2013.01); *B67D 1/0079* (2013.01); *B67D 3/0041* (2013.01); *B05B 7/0876* (2013.01)

(58) Field of Classification Search

CPC ..... B05B 11/3081; B05B 11/3084; B05B 11/3045–3047; B05B 11/0037; B05B 11/0054; B05B 11/0078; B65D 81/3216–3227; B65D 81/3283; B65D 81/3288; A45D 40/24

See application file for complete search history.

(56) References Cited

U.S. PATENT DOCUMENTS 3,439,841 A * 4/1969 Rhodes ..... B65D 47/265 222/142.5
4,355,739 A * 10/1982 Vierkotter ..... B05B 11/3081 222/134

(Continued)

FOREIGN PATENT DOCUMENTS

KR 10-1923306 B1 11/2018

*Primary Examiner* — Paul R Durand
*Assistant Examiner* — Randall A Gruby
(74) *Attorney, Agent, or Firm* — Heedong Chae; Lucem, PC

(57) ABSTRACT

The heterogeneous contents mixing container includes a first container formed therein with a content storage space and a container coupling space separated from each other; a second container coupled to the first container and formed with an inlet and a coupling portion; a first discharge unit installed in the first container to discharge stored contents; a second discharge unit installed in the second container to discharge stored contents; and a push button configured to operate the first and second discharge units and formed with first and second discharge passages and first and second outlets which are connected to the first and second discharge units, respectively, wherein the container coupling space of the first container and the inlet and the coupling portion of the second container deviate to one side from a center between the first and second containers, and the second discharge is connected to the second discharge passage.

7 Claims, 9 Drawing Sheets

(56) References Cited

U.S. PATENT DOCUMENTS

| | | | | |
|---|---|---|---|---|
| 5,224,627 | A * | 7/1993 | Weag | B05B 11/3005 239/600 |
| 5,339,990 | A * | 8/1994 | Wilder | B05B 11/3084 222/145.6 |
| 5,411,176 | A * | 5/1995 | Favre | B05B 11/3084 222/137 |
| 6,305,578 | B1 * | 10/2001 | Hildebrandt | B01F 35/71805 222/145.5 |
| 6,454,135 | B1 * | 9/2002 | Brozell | B05B 11/3011 222/162 |
| 6,672,483 | B1 * | 1/2004 | Roy | B05B 11/0038 222/136 |
| 9,693,619 | B2 * | 7/2017 | Ki | B65D 47/06 |
| 9,925,550 | B2 * | 3/2018 | Dring | A61L 2/22 |
| 10,160,592 | B2 * | 12/2018 | Sugawara | B65D 83/38 |
| 10,195,625 | B2 * | 2/2019 | Lee | B05B 11/0081 |
| 10,583,450 | B2 * | 3/2020 | Brugger | B05B 11/3073 |
| RE48,427 | E * | 2/2021 | Bruder | A45D 40/24 |
| 11,034,503 | B1 * | 6/2021 | Lee | B65D 81/3255 |
| 11,180,304 | B2 * | 11/2021 | Lee | A45D 34/06 |
| 2011/0108507 | A1 * | 5/2011 | Sullivan | B05B 11/3001 215/256 |
| 2011/0315712 | A1 * | 12/2011 | Chiba | B05B 11/3009 222/137 |
| 2016/0286932 | A1 * | 10/2016 | Lee | A45D 40/24 |
| 2018/0072553 | A1 * | 3/2018 | Lyons | A47J 31/40 |
| 2019/0357656 | A1 * | 11/2019 | Kang | A45D 19/022 |
| 2019/0366370 | A1 * | 12/2019 | Kang | A45D 40/24 |
| 2020/0054114 | A1 * | 2/2020 | Kang | A45D 33/26 |
| 2020/0315318 | A1 * | 10/2020 | Lee | A45D 40/26 |
| 2020/0361694 | A1 * | 11/2020 | Lee | B65D 81/3222 |
| 2021/0330056 | A1 * | 10/2021 | Lee | A45D 34/00 |

* cited by examiner

HETEROGENEOUS CONTENTS MIXING CONTAINER

BACKGROUND

The present invention relates to a heterogeneous contents mixing container, and more particularly, to a heterogeneous contents mixing container in which a coupling portion and a second discharge unit deviate to one side from the center of a second container are screw-coupled to a lower portion of a first container and the sizes and installation heights of the first and second discharge units are different from each other, so that the first and second containers are easily coupled to prevent contents from being contaminated and heterogeneous contents are simultaneously discharged at a predetermined mixing ratio to improve convenience in use and efficiency.

In general, there are many cases where two or more heterogeneous contents are mixed and used in order to enhance the efficacy or effect of cosmetics or medicines contained in a container.

However, when the contents required to be mixed for use are distributed and kept after being mixed and contained together in a single container in advance, a chemical reaction occurs in the container, so that the contents solidify or precipitate, resulting in poor discharge or discoloration or alteration of the contents.

For this reason, according to the related art, there has been proposed a scheme in which, after the contents having different components are contained in different containers, when used, the user discharges the contents and mixes the discharged contents directly. Alternatively, there has been scheme in which the heterogeneous contents are contained in separate containers, and when used, the contents are mixed in a separate container after opening the inlets of two containers. Such schemes have inconvenience of requiring a user to mix the contents contained in separated containers for use, a risk of loss, and poor portability.

Accordingly, recently, there has been developed a heterogeneous contents mixing container in which heterogeneous contents are contained in a single container while being separated, and the contents are mixed for use by a user's manipulation if necessary.

As a related art, there is disclosed a heterogeneous contents mixing container in Korean Registered Patent No. 10-1923306, where an inner container is inserted and installed into an outer container, one of a pump sets installed in the inner container, different cosmetic contents are contained in the inner and outer containers, respectively, and the cosmetic contents are mixed and used by simultaneously dispensing the cosmetic contents with one pumping.

However, since the related art is a structure in which the inner contained is contained together with the cosmetic contents contained in the outer container, foreign substances, which are stuck on the outer periphery of the inner container in the process of assembling the inner container with the outer container or replacing the inner container, are introduced into the outer container, thereby contaminating the cosmetic contents contained in the outer container. In addition, as the entire inner container is inserted into the opened inlet of the outer container, the contents contained in the outer container overflow due to the volume or sudden insertion of the inner container, so that the surroundings are contaminated and the assembly is inconvenient.

In addition, according to the related art, although the structure of each pump set and the amount of contents to be discharged are different from each other, the installation location of the pump set and the length of the discharge passage are the same, so that the heterogeneous contents discharged through each pump set are discharged to an outside with a time difference, so it is inconvenient to use the mixing container.

SUMMARY

To solve the problems described above, an object of the present invention is to provide a heterogeneous contents mixing container, in which the first and second containers in which heterogeneous contents are stored are connected to the first and second discharge units, respectively, dispense the heterogeneous contents to an outside at once, a coupling portion of the second container and the second discharge unit deviate to one side from the center of the first and second containers, and the second discharge unit is connected to the second discharge passage of a push button while being screw-coupled to a lower portion of the first container, so that it is easy to couple the first and second containers, and it is possible to prevent the contents from being contaminated by foreign substances during the coupling process.

Another object of the present invention is to provide heterogeneous contents mixing container in which the contents storage capacities of the first and second containers 10 and 20 and the sizes and installation heights of the first and second discharge units 30 and 40 installed in the first and second containers 10 and 20 are formed differently from each other, such that the heterogeneous contents discharged from the first and second discharge units 30 and 40 are simultaneously discharged to an outside at a predetermined mixing ratio without a time difference, thereby improving convenience and efficiency of use.

According to the present invention, there is provided a heterogeneous contents mixing container which includes a first container formed therein with a content storage space and a container coupling space which are separated from each other; a second container coupled to the first container and formed with an inlet and a coupling portion; a first discharge unit installed in the first container to discharge stored contents; a second discharge unit installed in the second container to discharge stored contents; and a push button configured to operate the first and second discharge units and formed with first and second discharge passages and first and second outlets which are connected to the first and second discharge units, respectively, wherein the container coupling space of the first container and the inlet and the coupling portion of the second container deviate to one side from a center between the first and second containers, and the second discharge is connected to the second discharge passage as the coupling portion of the second container is screw-coupled to a lower portion of the container coupling space of the first container.

A cap member formed therein with a support plate may be further coupled to the first container, and the support plate may be formed with a discharge unit installation hole to install the first discharge unit and formed with a discharge passage through-hole through which the second discharge passage passes.

The first and second discharge units may include pumps configured to discharge contents to an outside through pumping.

The first discharge unit may be formed to have a size relatively smaller than a size of the second discharge unit, and the second discharge unit may be installed at a height relatively lower than a height of the first discharge unit, such that heterogeneous contents are discharged to an outside while being mixed at a predetermined ratio due to differences between the sizes and heights of the first and second discharge units.

The mixing ratio of the contents discharged by each of the first and second discharge units may be 1:4 to 1:5.

The first discharge passage of the push button may be configured to have a length relatively shorter than a length of the second discharge passage.

A soft sealing member may be formed on an end of the second discharge passage of the push button and may be fitted with the second discharge unit installed in the second container when the first container is coupled to the second container.

According to the embodiments of the present invention, the coupling portion of the second container and the second discharge unit deviate to one side from the center of the first and second containers, and the second discharge unit is connected to the second discharge passage, so that it is easy to couple the first and second containers, and it is possible to prevent the contents from being contaminated by foreign substances during the coupling process.

In addition according to the embodiments of the present invention, the contents storage capacities of the first and second containers and the sizes and installation heights of the first and second discharge units installed in the first and second containers are formed differently from each other, such that the heterogeneous contents discharged from the first and second discharge units can be simultaneously discharged to an outside at a predetermined mixing ratio without a time difference, thereby improving convenience and efficiency of use.

In addition according to the embodiments of the present invention, the first and second discharge units are installed into the first and second containers, respectively and the heterogeneous contents are mixed and used by coupling the first and second containers when necessary while the heterogeneous contents contained in the first and second container are discharged and used separately, so that it is possible to improve the utilization of the container.

DETAILED DESCRIPTION OF THE EMBODIMENTS

Figure 1:
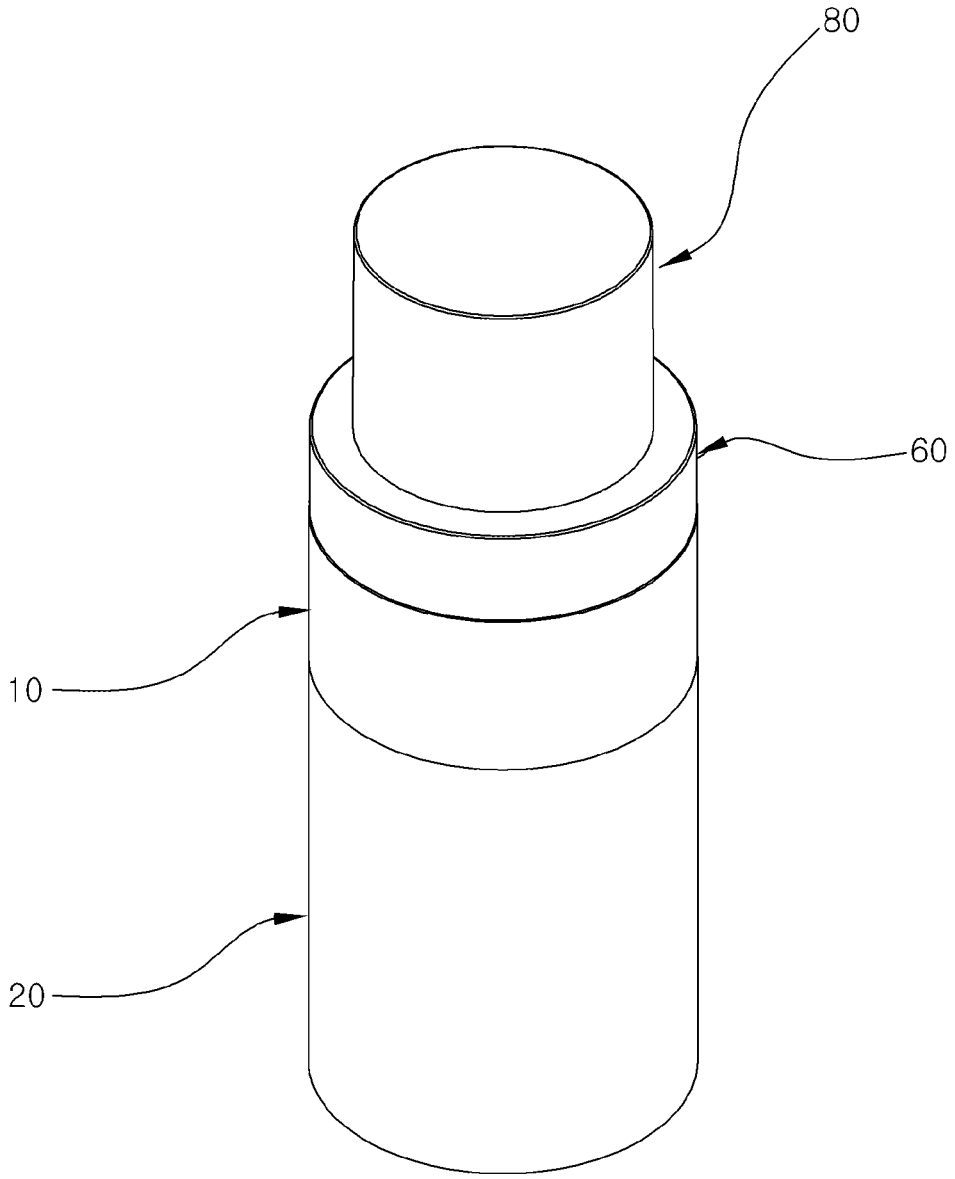
FIG. 1 is a perspective view of a mixing container according to an embodiment of the present invention.

In the following detailed description, reference is made to the accompanying drawings that show, by way of illustration, specific embodiments in which the present invention may be practiced. These embodiments are described in sufficient detail to enable those skilled in the art to practice the present invention. It is to be understood that the various embodiments of the present invention, although different, are not necessarily mutually exclusive. For example, a particular feature, structure, or characteristic described herein in connection with one embodiment may be implemented within other embodiments without departing from the spirit and scope of the present invention. In addition, it is to be understood that the location or arrangement of individual elements within each disclosed embodiment may be modified without departing from the spirit and scope of the present invention.

The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

With respect to the terms used in an example embodiment of the present invention, general terms currently and widely used are selected in view of function with respect to the present invention. However, the terms may vary according to an intention of a technician practicing in the pertinent art, an advent of new technology, etc. In specific cases, terms may be chosen arbitrarily, and in this case, definitions thereof will be described in the description of the corresponding present invention. Accordingly, the terms used in the description should not necessarily be construed as simple names of the terms, but be defined based on meanings of the terms and overall contents of the present invention.

In addition, when some part 'includes' some elements, unless explicitly described to the contrary, it means that other elements may be further included but not excluded.

A heterogeneous contents mixing container according to an embodiment of the present invention will be described with reference to FIGS. 1 to 9.

Figure 2:
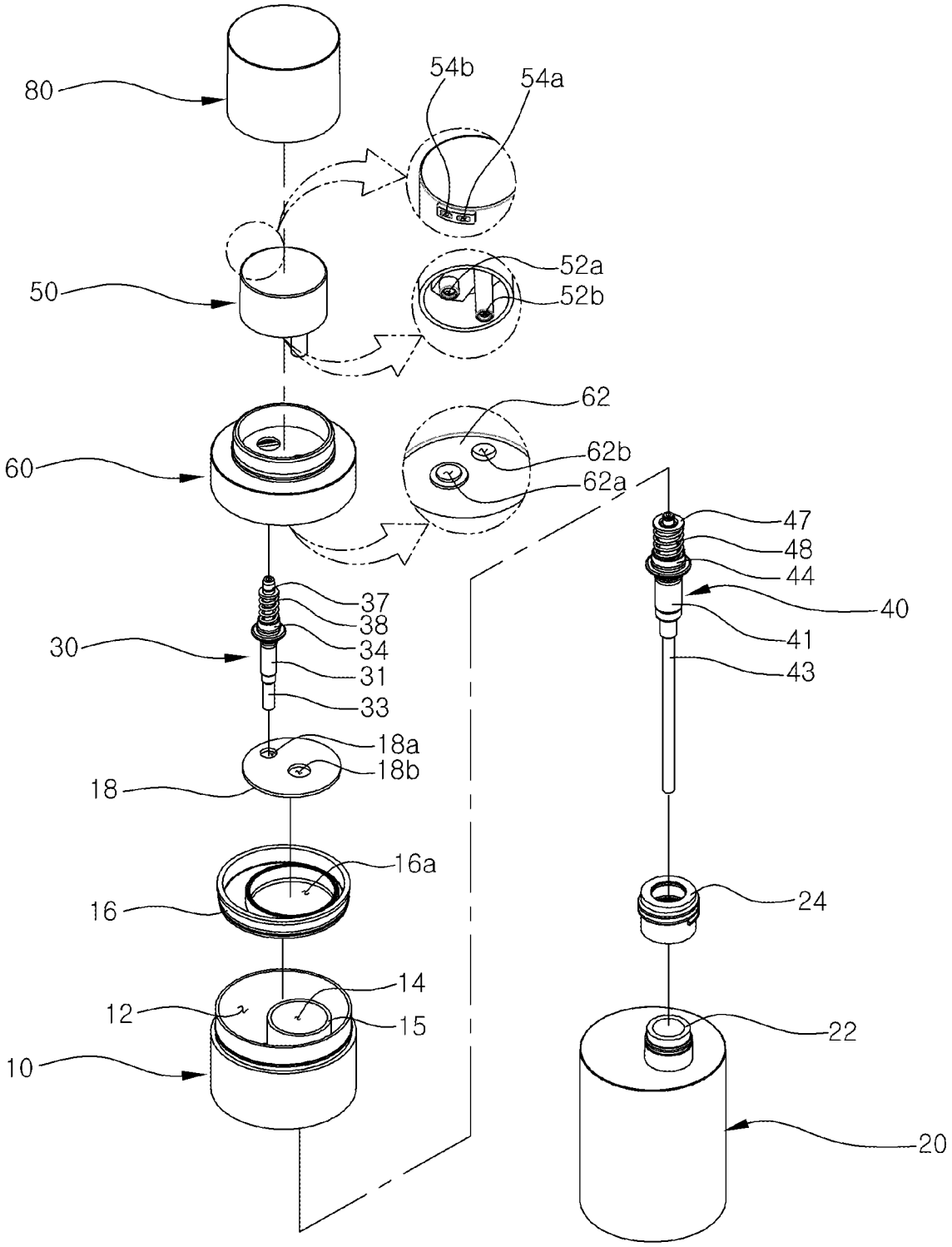
FIG. 2 is an exploded perspective view of a mixing container according to an embodiment of the present invention.
Figure 4:
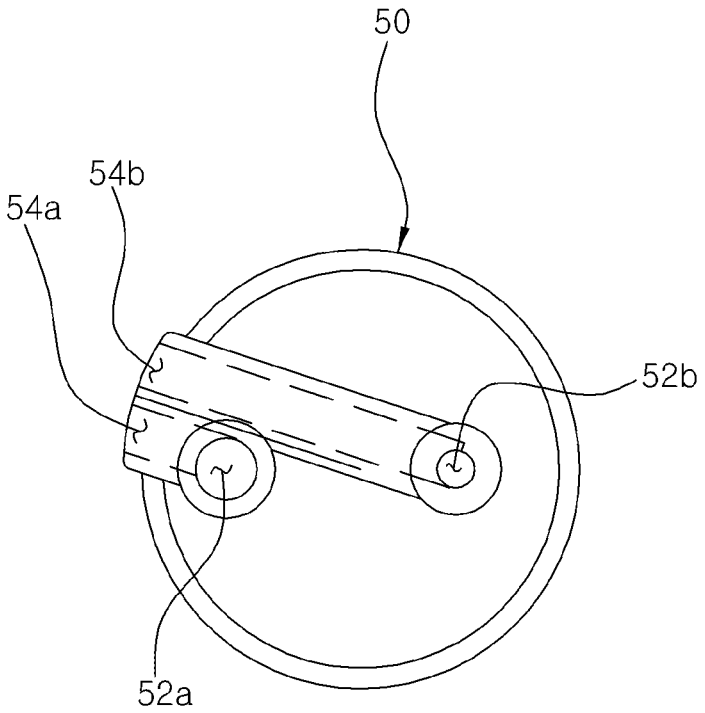
FIG. 4 is a plan view of a mixing container according to an embodiment of the present invention.

FIG. 1 is a perspective view of a mixing container according to an embodiment of the present invention. FIG. 2 is an exploded perspective view of a mixing container according to an embodiment of the present invention. 3 is a cross-sectional view of a mixing container according to an embodiment of the present invention. FIG. 4 is a plan view of a mixing container according to an embodiment of the present invention.

As shown, a mixing container according to an embodiment of the present invention may include a first container 10, a second container 20, a first discharge unit 30, and a second discharge unit 40, and a push button 50.

A liquid or gel type of first content C1 is contained in the first container 10 which is rigid and formed in a cylindrical shape. Of course, the first container 10 is not limited to the rigidity and the cylindrical shape, and may be formed in various shapes or materials.

A content storage space 12 may be formed the first container 10, in which the first content C1 and a part of the first discharge unit 30 is contained, and may be coupled to the second container 20 to form a container coupling space 14 in which the second discharge unit 40 is partially contained.

As shown in FIG. 2, the container coupling space 14 may deviate to one side from the center of the first container 10, and separated from the content storage space 12 by a partition wall 15.

In addition, a stepped sill 14*a* may protrudes inward from an inner periphery of the container coupling space 14, and a thread may be formed on a lower portion of the stepped sill 14*a* to be screw-coupled to the second container 20.

Figure 3:
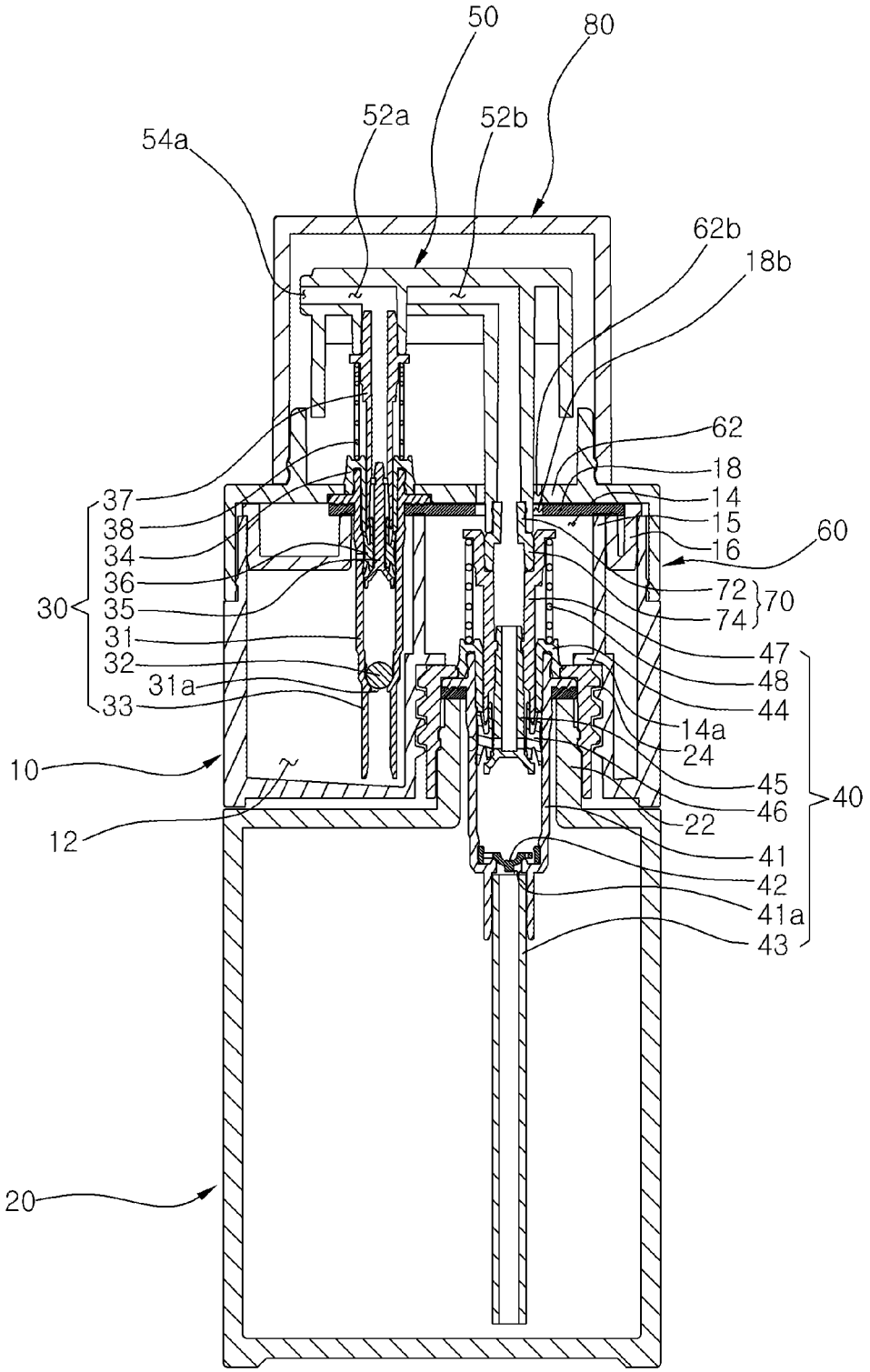
FIG. 3 is a cross-sectional view of a mixing container according to an embodiment of the present invention.

As shown in FIG. 3, the open upper portion of the first container 10 is coupled to a sealing cap 16, and a sealing plate 18 made of an elastic material is coupled to an upper portion of the sealing cap 16, thereby improving the airtightness of the first container 10. That is, the sealing cap 16 closes the open portion of the first container 10, and the sealing plate 18 is sandwiched between the sealing cap 16 and a cap member 60 to be described below to prevent the first content C1 contained in the inner space of the first container 10 from leaking to an outside or external foreign substances from flowing into the inner space of the first container 10.

The sealing cap 16 may be formed with a partition wall insertion hole 16*a* into which the partition wall 15 of the first container 10 is inserted, and the sealing plate 18 may be formed with a first through hole 18*a* through which the first discharge unit 30 passes and a second through hole 18*b* through which the second discharge passage 52*b* passes.

In this case, the sealing plate 18 is formed of a soft material. Preferably, the sealing plate 18 may be formed of one or more of urethane rubber, natural rubber, elastomer, nitrile-butadiene rubber (NBR) and silicone, or one or more of elastic polypropylene, polyethylene, acrylonitrile butadiene styrene (ABS) and Thermo plastic elastomer (TPE). Of course, the sealing plate 18 is not limited to the above-described materials, and may be formed of various materials having elasticity in a certain range.

Meanwhile, a cap member 60 may be further coupled to an upper portion of the first container 10. A support plate 62 may be formed inside the cap member 60. The support plate 62 is formed with a discharge unit installation hole 62*a* connected to the first through hole 18*a* of the sealing plate 18, to which the first discharge unit 30 is installed, and formed with a discharge passage through hole 62*b* connected to the second through hole 18*b* of the sealing plate 18, through which the second discharge passage 52*b* passes.

In the drawing of the mixing container according to an embodiment of the present invention, the first container 10 and the cap member 60 undercut-coupled to each other are illustrated, but the embodiment is not limited thereto. The first container 10 and the cap member 60 may be coupled to each other in various coupling schemes such as a coupling of a protrusion and a groove, a forcibly fitting, etc.

The second container 20 is coupled to the lower portion of the first container 10, and may be formed in a cylindrical shape corresponding to the first container 10 for continuity of the outer appearance of the mixing container.

A second content C2 may be kept in the second container 20. Preferably, the second content C2, which is different from the first content (C1), can enhance the efficacy or effect when used while being mixed with the first content C1.

An inlet 22 is formed at one side of the second container 20. The second content C2 is charged through the inlet 22 into which the second discharge unit 40 may be installed.

A coupling portion 24 is coupled to the inlet 22. The coupling portion 24 is fixedly coupled while surrounding the inlet 22 to fix the second discharge unit 40.

The outer periphery of the coupling portion 24 is formed with a screw thread which is screw coupled with the screw thread formed inside the container coupling space 14 of the first container 10, and the upper end of the coupling portion 24 is tightly closed to the stepped sill 14*a* of the coupling space 14. In this case, the coupling portion 24 and the inlet 22 are eccentric (the center of an object deviates to one side so that the centers do not match) like the container coupling space 14 of the first container 10. That is, the coupling portion 24 and the inlet 22 deviate to one side from the center of the second container 20.

In other words, the first and second containers 10 and 20 in which heterogeneous contents are stored are connected to the first and second discharge units 30 and 40, respectively, and dispense the heterogeneous contents to an outside at once. The coupling portion 24 and the second discharge unit 40 are formed in the second container 20 and deviate to one side from the center of the first and second containers 10 and 20. The second discharge unit 40 is connected to the second discharge passage 52*b* of the push button 50 while being screw-coupled to the lower portion of the first container 10. Therefore, it is easy to assemble the first and second containers 10 and 20 through screw coupling, and it is possible to prevent the contents from being contaminated by foreign substances during the assembly process.

Figure 5:
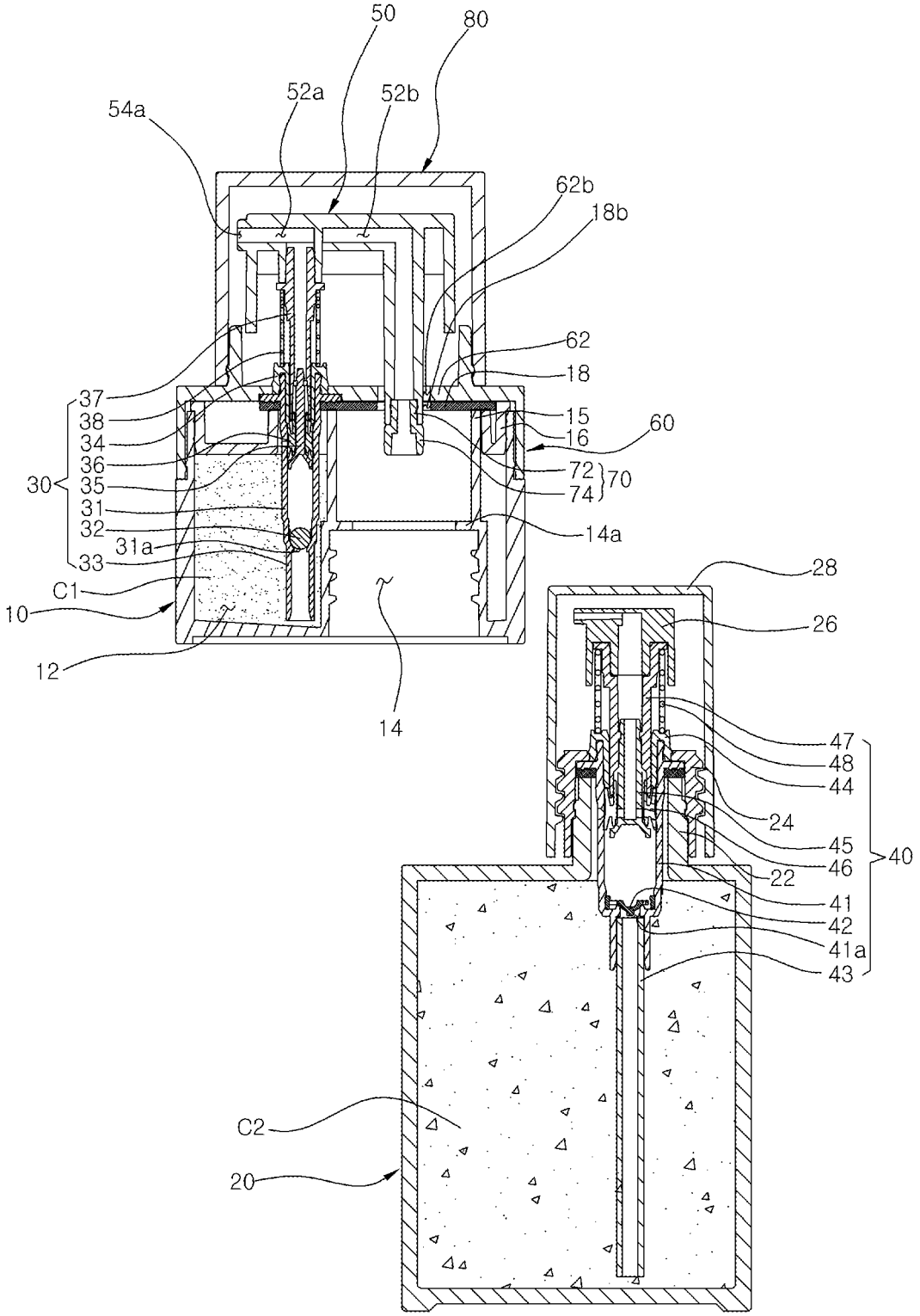
FIG. 5 is a cross-sectional view illustrating a state before the second container is coupled to the first container according to an embodiment of the present invention.
Figure 6:
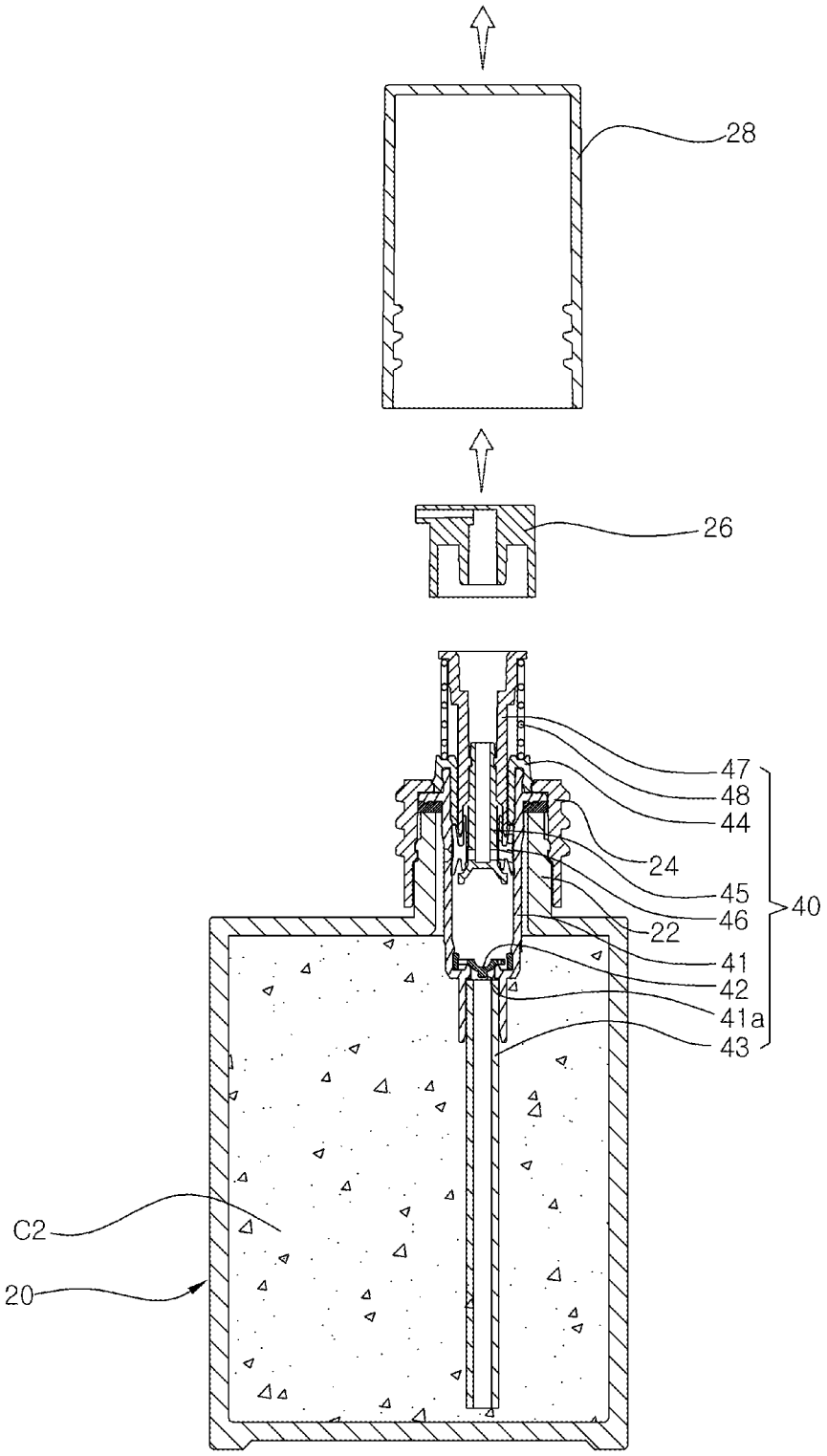
FIG. 6 is a cross-sectional view illustrating a state in which a temporary cover and a temporary push button of the second container are separated from each other according to an embodiment of the present invention.

FIG. 5 is a cross-sectional view illustrating a state before the second container is coupled to the first container according to an embodiment of the present invention. FIG. 6 is a cross-sectional view illustrating a state in which a temporary cover and a temporary push button of the second container are separated from each other according to an embodiment of the present invention.

Meanwhile, before the second container 20 is coupled to the first container 10, the second container 20 is individually packaged and distributed and sold separately from the first container 10. As shown in FIG. 5, the temporary push button 26 may be fixedly coupled to the second discharge unit 40 installed into the inlet 22 of the second container 20, and the temporary cover 28 may be detachably coupled to the coupling portion 24 of the second container 20.

Of course, when the second container 20 is coupled to the first container 10 to use a mixture of heterogeneous contents, as shown in FIG. 6, the temporary cover 28 is separated from the second container 20 and the temporary push button 26 is separated from the second discharge unit 40.

The first discharge unit 30 is installed into the discharge unit installation hole of the cap member 60 of the first container 10 in a state in which at least a portion of the first discharge unit 30 is inserted into the contents storage space 12 of the first container 10, and discharges the first contents (C1) stored in the first container 10 to an outside.

In this case, the first discharge unit 30 is preferably a pump for discharging a predetermined amount of contents to an outside by a pumping operation.

As shown in FIG. 3, the first discharge unit 30 may include a first housing 31 formed at one side thereof with a first content inlet 31*a*, a first suction valve 32 configured to open or close the first content inlet 31*a* of the first housing 31, a first suction pipe 33 coupled to a lower portion of the first housing 31 to suck the first contents C1 into the first housing 31, a first housing cap 34 fixedly coupled to an upper portion of the first housing 31, a first piston support 35 formed inside the first housing 31 to move in an operating direction of the pump, a first piston 36 fitted to the outside of the first piston support 35 to be is in close contact with the inner surface of the first housing 31, a first stem 37 coupled to an upper portion of the first piston support 35, and a first spring 38 elastically supporting the first stem 37.

The second discharge unit 40 is installed into the inlet 22 of the second container 20, and at least some of the entire configuration is contained in the container coupling space 14 of the first container 10. The second discharge unit 40 discharges the second content (C2) kept in the second container 20 to an outside.

The second discharge unit 40, which is a pump for discharging a predetermined quantity of contents to an outside by a pumping operation, is fixed to the inlet 22 by the coupling portion 24 of the second container 20. In addition, the second discharge unit 40 deviates to one side from the center of the second container 20 because the inlet 22 and the coupling portion 24 are formed eccentrically in the second container 20.

As shown in FIG. 3, the second discharge unit 40 may include a second housing 41 formed at one side thereof with a second content inlet 41*a*, a second suction valve 42 configured to open or close the second content inlet 41*a* of the second housing 41, a second suction pipe 43 configured to suck the second contents C2 into the second housing 31, a second housing cap 44 coupled to an upper portion of the first housing 31 to fix the second housing to one side of the second container 20, a second piston support 45 formed inside the second housing 31 to move in an operating direction of the pump, a second piston 46 fitted to the outside of the second piston support 45 to be is in close contact with the inner surface of the second housing 31, a second stem 47 coupled to an upper portion of the second piston support 45, and a second spring 48 elastically supporting the second stem 37.

In this case, when the coupling portion 24 of the second container 20 is screw-coupled while being inserted into the container coupling space 14 of the first container 10, the second discharge unit 40 may be connected through the second discharge passage 52*b* of the push button 50 and the sealing member 70.

In a state where the sealing member 70 is formed of a soft material and is coupled to the second discharge passage 52*b* of the push button 50, when the first container 10 and the second container 20 are coupled, the sealing member 70 is fitted into the second discharge unit 40 installed into the second container 20, so that the push button 50 and the second discharge unit 40 are connected while being stably sealed.

In other words, the sealing member 70 may include a coupling portion 72 which is formed in a tube shape of which upper and lower portions are opened and which is coupled to the second discharge passage 52*b*, and a sealing insertion portion 74 inserted into the upper portion of the second discharge unit 40. The coupling portion 72 is inserted and fixedly coupled to an end of the second discharge passage 52*b*, and the sealing insertion portion 74 is tightly fitted into an upper inner periphery of the second stem 47 of the second discharge unit 40.

Meanwhile, as shown in FIG. 3, the first and second discharge units 30 and 40 may have sizes different from each other according to the content mixing ratio of the first and second containers 10 and 20. That is, when the first container 10 and the second container 20 are coupled to use heterogeneous contents, to adjust the first content C1 stored in the first container 10 and the second content C2 stored in the second containers 20 at an optimal mixing ratio, the content storing volumes of the first and second containers 10 and 20 may be different from each other, and at the same time, the sizes of the first and second discharge units 30 and 40 may be different from each other.

For example, when the first content C1 discharged by the first discharge unit 30 is discharged more or less than the second content C2 discharged by the second discharge unit 40 for mixing and use, the first housing 31 of the first discharge unit 30 and the components operated inside and outside the first housing 31 may be formed to have sizes larger or smaller than those of the second housing 41 of the second discharge unit 40 and the components operated inside and outside the second housing 41.

In this case, it is appropriate that the mixing ratio of contents discharged through the first and second discharge units 30 and 40 is 1:4 to 1:5. Accordingly, the inner area of the second container 20 and the second housing 41 of the second discharge unit 40 may be 4 to 5 times larger than that of the first container 10 and the first housing 31 of the first discharge unit 30. Of course, the mixing ratio of the first and second contents C1 and C2 is not limited thereto, and may be variously changed according to each kind of contents stored in the first and second containers 10 and 20, the purpose and method of use, etc.

In addition, as shown in FIG. 3, the second discharge unit 40 is preferably installed at a relatively lower height than the first discharge unit 30. That is, the second discharge unit 40 is installed below the first discharge unit 30 based on the inner upper end of the push button 50 and is eccentric to the second container 20, so that the second discharge unit 40 pumping a relatively large amount of contents is far away from the outlet than the first discharge unit 30. Accordingly, the first content C1 pumped by the first discharge unit 30 and the second content C2 pumped by the second discharge unit 40 are simultaneously discharged to an outside.

As described above, according to the present invention, the contents storage capacities of the first and second containers 10 and 20 and the sizes and installation heights of the first and second discharge units 30 and 40 installed in the first and second containers 10 and 20 are formed differently from each other, such that the heterogeneous contents discharged from the first and second discharge units 30 and 40 are simultaneously discharged to an outside at a predetermined mixing ratio without a time difference, thereby improving convenience and efficiency of use.

The push button 50 is formed to be movable up and down on one side of the first container 10, and is operated together with the first and second discharge units 30 and 40 while being pressed by a user's pressing operation.

The first and second discharge passages 52*a* and 52*b* respectively connected to the first and second discharge units 30 and 40 described above may be formed inside the push button 50, and the first and second outlets 54*a* and 54*b* may be formed on one side ends exposed to outsides of the first and second discharge passages 52*a* and 52*b*, respectively. The first and second outlets 54*a* and 54*b* may be arranged along the outer periphery of the push button 50.

The first discharge passage 52*a* of the push button 50 is coupled to the first stem 37 of the first discharge unit 30 to allow the first content C1 pumped by the first discharge unit 30 to move to the first outlet 54*a*. The second discharge passage 52*b* is coupled to the second stem 47 of the second discharge unit 30 to allow the second content C2 pumped by the second discharge unit 40 to move to the second outlet 54*b*.

Meanwhile, as shown in FIG. 4, it is preferable that the first and second discharge passages 52*a* and 52*b* have different lengths from each other. That is, when the first and second contents C1 and C2 are mixed and used by making the discharge amounts of the first and second contents C1 and C2 different through the difference between the sizes of the first and second discharge unit 30 and 40, the first and second contents C1 and C2 are discharged from the first and second discharge passages 52*a* and 52*b* having the same length with a time difference. Therefore, the first discharge passage 52*a* connected to the first discharge unit 30 with a relatively small discharge amount is formed to be shorter than the second discharge passage 52*b* connected to the second discharge unit 40 with a relatively large discharge amount, such that the first and second contents C1 and C2 can be discharged to an outside at the same timing.

In addition, as shown in FIG. 3, a container cover 80, which protect the push button 50 while protecting the push button 50 when carrying or keeping the mixing container, may be detachably coupled to the cap member 60.

Figure 7:
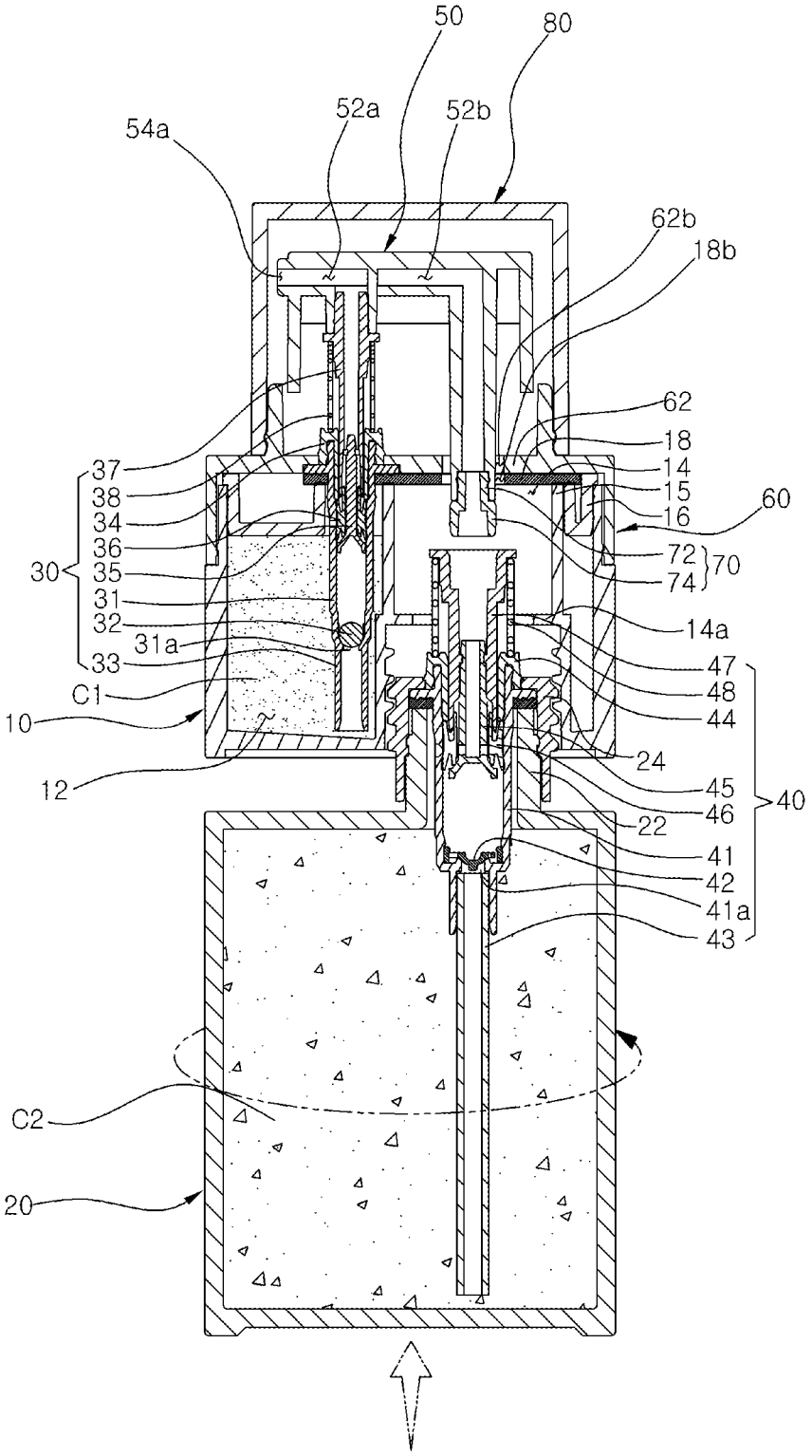
FIG. 7 is a cross-sectional view illustrating a state in which the second container is screw-coupled to a lower portion of the first container according to an embodiment of the present invention.
Figure 8:
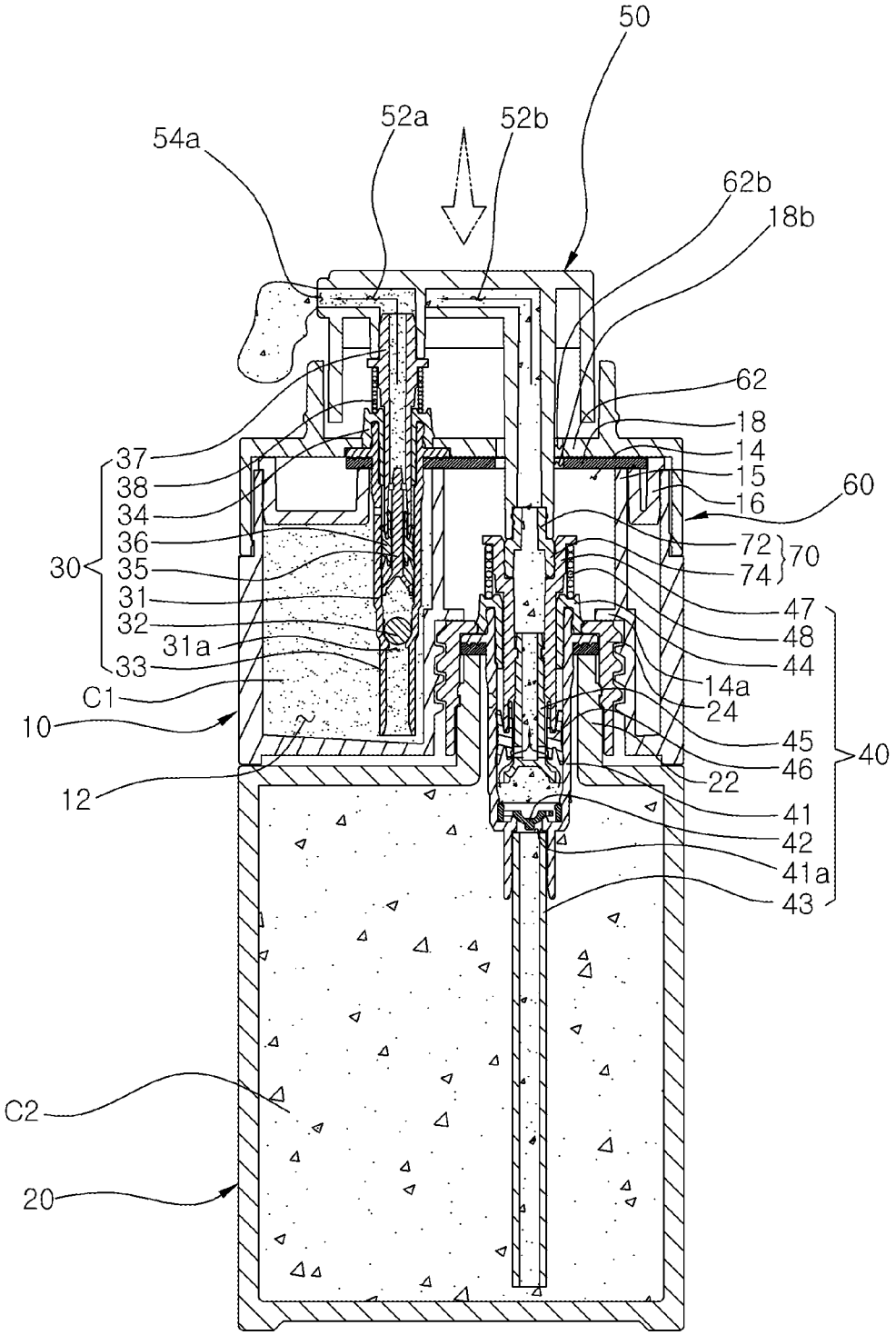
FIG. 8 is a cross-sectional view illustrating a state in which the push button of the mixing container according to an embodiment of the present invention is pushed to allow the heterogeneous contents to be simultaneously discharged.
Figure 9:
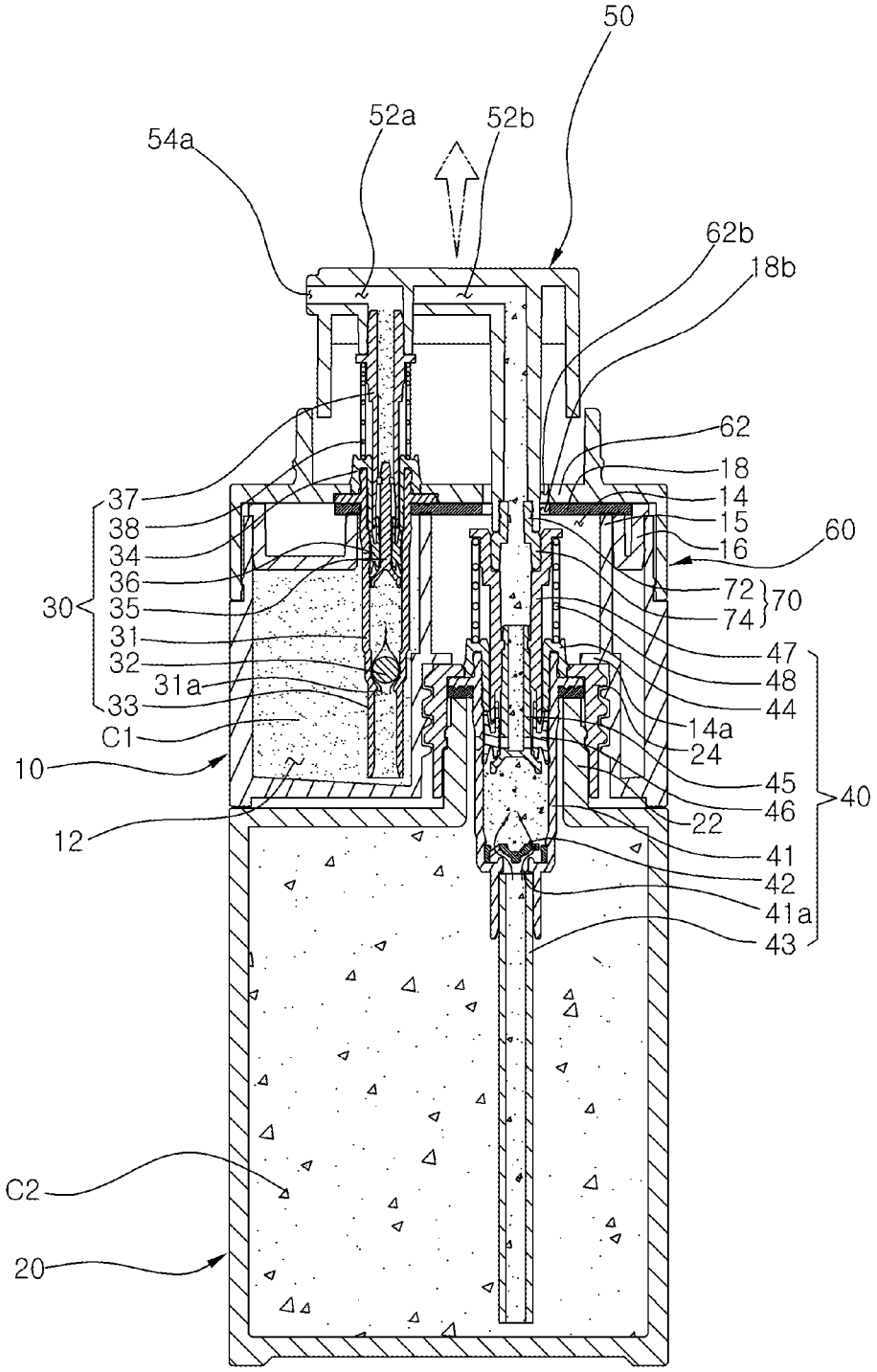
FIG. 9 is a cross-sectional view illustrating a state in which the contents are introduced into the first and second discharge units while the push button of the mixing container according to an embodiment of the present invention is restored to its original position.

FIGS. 7 to 9 are views illustrating the assembly and use of a heterogeneous contents mixing container according to an embodiment of the present invention. Hereinafter, the processes of assembling and using a heterogeneous contents mixing container according to an embodiment of the present invention will be described with reference to FIGS. 7 and 8.

FIG. 7 is a cross-sectional view illustrating a state in which the second container is screw-coupled to a lower portion of the first container according to an embodiment of the present invention. FIG. 8 is a cross-sectional view illustrating a state in which the push button of the mixing container according to an embodiment of the present invention is pushed to allow the heterogeneous contents to be simultaneously discharged. FIG. 9 is a cross-sectional view illustrating a state in which the contents are introduced into the first and second discharge units while the push button of the mixing container according to an embodiment of the present invention is restored to its original position.

First, in order to assemble the mixing container according to an embodiment of the present invention, as shown, the first content C1 is charged into the content storage space 12 of the first container 10, and after the sealing cap 16 is coupled to the opened upper portion of the container 10, the sealing plate 18 is placed on the upper portion of the sealing cap 16. In this case, the first through hole 18*a* of the sealing plate 18 is located at the upper portion of the content storage space 12 of the first container 10, and the second through hole 18*b* of the first container 10 is located on the upper portion of the container coupling space 14 of the first container 10.

Next, the first discharge unit 30, which includes the first housing 31, the first suction valve 32, the first suction pipe 33, the first housing cap 34, the first piston support 35, the first piston 36, the first stem 37, and the first spring 38, is installed into the first through hole 18*a* of the sealing plate 18, and the cap member 60 is fixedly coupled to the upper portion of the first container 10.

Next, the push button 50 is coupled to the upper portion of the cap member 60 to be movable up and down. The first discharge passage 52*a* of the push button 50 is coupled to the first stem 37 of the first discharge unit 30. The second discharge passage 52*b* is inserted into the discharge passage through hole 62*b* of the cap member 60 and the second through hole 18*b* of the sealing plate 18. In this case, the soft sealing member 70 is coupled to the end of the second discharge passage 52*b* of the push button 50.

Next, while surrounding the push button 50, the container cover 80 is detachably coupled to the cap member 60.

Next, the second content C2 is charged through the inlet 22 of the second container 20. The second discharge unit 40, which includes the second housing 41, the second suction valve 42, the second suction pipe 43, the second housing cap 44, the second piston support 45, the second piston 46, the second stem 47, and the second spring 48, is installed to the inlet 22, and then, the coupling portion 24 is coupled to the outside of the inlet 22 of the second container 20.

Thereafter, as shown in FIG. 5, the first container 10 and the second container 20 assembled as described above are packaged separately. In this case, the temporary push button 26 is coupled to the end of the second discharge unit 40, and the temporary cover 28 is coupled to the second container 20.

Meanwhile, even when it is desired to use the mixing container assembled as described above, as shown in FIG. 6, the temporary cover 28 coupled to the second container 20 is separated from the temporary push button 26 coupled to the second discharge unit 40.

Thereafter, as shown in FIG. 7, the coupling portion 24 of the second container 20 is screw coupled by rotating the coupling portion 24 in one direction while inserting the coupling portion 24 into the lower portion of the container coupling space 14 of the first container 10. In this case, the upper end of the coupling portion 24 of the second container 20 is tightly closed to the stepped sill 14*a* of the first container 10, and the second discharge unit 40 and the second discharge passage 52*b* are connected to each other by the sealing member 70. Accordingly, the first content C1 stored in the first container 10 and the second content C2 stored in the second container 20 may be discharged together through the first and second discharge unit 30 and 40.

Thereafter, as shown in FIG. 8, the first content C1 stored in the first container 10 and the second content C2 stored in the second container 20 are discharged together when the first and second discharge units 30 and 40 are simultaneously pressed by pushing the push button 50, and the discharged heterogeneous contents are mixed and used.

In more detail, when the first and second discharge units 30 and 40 are pressed together, the first and second stems 37 and 47 and the first and second piston supports 35 and 45 coupled to the lower portions of the first and second stems 37 and 47 move downward. In this case, since the first and second pistons 36 and 46 of the first and second discharge units 30 and 40 make close contact with the inner surfaces of the first and second housings 31 and 41, while the first and second piston supports 35 and 45 move downward, a gap is generated between the first and second piston supports 35 and 45 and the first and second pistons 36 and 46, thereby generating the discharge passages of the first and second contents C1 and C2.

Thereafter, the first and second pistons 36 and 46 are pressed by the lower ends of the first and second stems 37 and 47 moved downward, so that the inner volumes of the first and second housings 31 and 41 are reduced. Accordingly, while the first and second suction valves 32 and 42 close the first and second content inlets 31*a* and 41*a* due to the discharge pressures in the first and second housings 31 and 41, the first and second contents C1 and C2 contained in the first and second housings 3 and 41 come out between the first and second piston supports 35 and 45 and the first and second pistons 36 and 46, and pass through the insides of the first and second piston supports 35 and 45 and the first and second discharge passages 52*a* and 52*b*, so that the first and second contents C1 and C2 are discharged through the first and second outlets 54*a* and 54*b*.

Then, as shown in FIG. 9, when the pressure of the push button 50 is released, due to the elasticity of the first and second springs 38 and 48 elastically supporting the first and second stems 37 and 47, the first and second piston supports 35 and 45 coupled to the lower sides of the first and second stems 37 and 47 move upward. In this case, the lower portions of the first and second piston supports 35 and 45 pulls up the first and second pistons 36 and 46, and the first and second piston supports 35 and 45 and the first and second pistons 36 and 46 move upward while the gap between the first and second piston supports 35 and 45 and the first and second pistons 36 and 46 is blocked.

Accordingly, the inner volumes of the first and second housings 31 and 41 are increased to generate vacuum pressures, and while the first and second suction valves 32 and 42 are lifted by the vacuum pressures, the first and second content inlets 31*a* and 41*a* are opened, so that the first and second contents C1 and C2 stored in the first and second containers 10 and 20 are introduced into the first and second housings 31 and 41.

Thereafter, the first and second contents C1 and C2 which are heterogeneous and discharged together as described above are used while being mixed.

While the present invention has been described above using particular examples, including specific elements, by way of limited embodiments and drawings, it is to be appreciated that these are provided merely to aid the overall understanding of the present invention, the present invention is not to be limited to the embodiments above, and various modifications and alterations can be made from the disclosures above by a person having ordinary skill in the art to which the present invention pertains.

Therefore, the spirit of the present invention must not be limited to the embodiments described herein, and the scope of the present invention must be regarded as encompassing not only the claims set forth below, but also their equivalents and variations.

What is claimed is:

1. A heterogeneous contents mixing container comprising:

a first container formed therein with a content storage space and a container coupling space which are separated from each other;

a second container coupled to the first container and formed with an inlet and a coupling portion;

a first discharge unit installed in the first container to discharge stored contents;

a second discharge unit installed in the second container to discharge stored contents; and a push button configured to operate the first and second discharge units and formed with first and second discharge passages and first and second outlets which are connected to the first and second discharge units, respectively, wherein the container coupling space of the first container and the inlet and the coupling portion of the second container deviate to one side from a center between the first and second containers, and the second discharge unit is connected to the second discharge passage as the coupling portion of the second container is screw-coupled to a lower portion of the container coupling space of the first container.

2. The heterogeneous contents mixing container of claim 1, wherein a cap member formed therein with a support plate is further coupled to the first container, and the support plate is formed with a discharge unit installation hole to install the first discharge unit and formed with a discharge passage through-hole through which the second discharge passage passes.

3. The heterogeneous contents mixing container of claim 1, wherein the first and second discharge units include pumps configured to discharge contents to an outside through pumping.

4. The heterogeneous contents mixing container of claim 1, wherein the first discharge unit is formed to have a size relatively smaller than a size of the second discharge unit, and the second discharge unit is installed at a height relatively lower than a height of the first discharge unit, such that heterogeneous contents are discharged to an outside while being mixed at a predetermined ratio due to differences between the sizes and heights of the first and second discharge units.

5. The heterogeneous contents mixing container of claim 1, wherein the mixing ratio of the contents discharged by each of the first and second discharge units is 1:4 to 1:5.

6. The heterogeneous contents mixing container of claim 1, wherein the first discharge passage of the push button is configured to have a length relatively shorter than a length of the second discharge passage.

7. The heterogeneous contents mixing container of claim 1, wherein a soft sealing member is formed on an end of the second discharge passage of the push button and is fitted with the second discharge unit installed in the second container when the first container is coupled to the second container.

* * * * *